US010399747B2

(12) United States Patent
Ahmed

(10) Patent No.: US 10,399,747 B2
(45) Date of Patent: Sep. 3, 2019

(54) TOOTHPASTE CAP WITH DENTAL CARE TOOLS

(71) Applicant: UNITED ARAB EMIRATES UNIVERSITY, Al Ain (AE)

(72) Inventor: Waleed Khalil Ahmed, Al Ain (AE)

(73) Assignee: United Arab Emirates University, Al-Ain (AE)

( * ) Notice: Subject to any disclaimer, the term of this patent is extended or adjusted under 35 U.S.C. 154(b) by 0 days.

(21) Appl. No.: 16/207,354

(22) Filed: Dec. 3, 2018

(65) Prior Publication Data

US 2019/0100363 A1 Apr. 4, 2019

Related U.S. Application Data

(63) Continuation-in-part of application No. 15/639,855, filed on Jun. 30, 2017, now Pat. No. 10,202,223.

(51) Int. Cl.

| | |
|---|---|
| ***B65D 35/28*** | (2006.01) |
| ***B65D 35/44*** | (2006.01) |
| *B65D 51/24* | (2006.01) |

(52) U.S. Cl.

CPC ..... *B65D 35/28* (2013.01); *B65D 35/44* (2013.01); *B65D 51/24* (2013.01)

(58) Field of Classification Search

CPC ..... A61M 5/282; B05B 11/00412; B05C 17/00583; B21D 51/36; B21D 51/249; B21D 51/24; B21D 51/243; B21D 51/32; B65D 35/00; B65D 35/24; B65D 35/34; B65D 35/28; B65D 35/44; B65D 83/0055; B65D 83/62; B67D 1/0001; B67D 1/0462; B65B 69/005

See application file for complete search history.

(56) References Cited

U.S. PATENT DOCUMENTS

| | | | | |
|---|---|---|---|---|
| 1,731,703 A * | 10/1929 | Bourke | ..... | B65D 35/18 141/360 |
| 1,733,114 A | 10/1929 | Brennan | | |
| 2,084,568 A | 6/1937 | White | | |

(Continued)

FOREIGN PATENT DOCUMENTS

| | | | |
|---|---|---|---|
| FR | 2888733 | * | 7/2005 |
| KR | 1020110038283 | A | 4/2011 |
| TW | 508514 | U | 9/2015 |

*Primary Examiner* — Patrick M. Buechner
*Assistant Examiner* — Randall A Gruby
(74) *Attorney, Agent, or Firm* — Richard C. Litman

(57) ABSTRACT

The toothpaste cap with dental care tools includes a cap for sealing an open end of a squeezable tube dispenser. The cap is formed as a hollow body having a closed upper end and an open lower end. A cylindrical retaining member is mounted, substantially centrally, to a lower face of the closed upper end within the hollow body. The cylindrical retaining member is adapted for releasably receiving and sealing a spout of a squeezable tube dispenser. The cap can have a first sidewall having a flat planar contour and a second sidewall having an arcuate contour. The flat, planar first sidewall of the hollow body is adapted for pressing against the squeezable tube dispenser to selectively manually manipulate contents thereof. Alternatively, the cap can have a substantially cylindrical sidewall and a squeezing member attached to an exterior surface thereof.

18 Claims, 12 Drawing Sheets

(56) References Cited

U.S. PATENT DOCUMENTS

| | | | | | |
|---|---|---|---|---|---|
| 3,428,220 | A * | 2/1969 | Osrow | B65D 83/40 | 222/153.02 |
| 3,586,212 | A * | 6/1971 | Tzouras | B65D 35/24 | 222/93 |
| 4,520,951 | A * | 6/1985 | Facey | B65D 83/40 | 222/182 |
| 5,823,405 | A * | 10/1998 | Benns | B65D 83/303 | 222/538 |
| 5,979,706 | A * | 11/1999 | Grussmark | A61C 15/043 | 222/105 |
| 6,732,879 | B2 | 5/2004 | Hamann | | |
| 8,006,709 | B1 | 8/2011 | Ebnayamin | | |
| 9,205,961 | B2 * | 12/2015 | Gonnert | B65D 47/0814 | |
| 9,301,820 | B2 | 4/2016 | Hintz | | |
| 2016/0304249 | A1 * | 10/2016 | Beckerman | B65D 35/24 | |
| 2018/0035797 | A1 | 2/2018 | Mahawar | | |

* cited by examiner

TOOTHPASTE CAP WITH DENTAL CARE TOOLS

CROSS-REFERENCE TO RELATED APPLICATION

This application is a continuation-in-part of U.S. patent application Ser. No. 15/639,855, filed on Jun. 30, 2017.

BACKGROUND

1. Field

The disclosure of the present patent application relates to packaging, and dispensing, and particularly, to a cap for a squeezable tube dispenser, such as industrial paste tubes, medical paste tubes, chemical paste tubes, toothpaste tubes and the like.

2. Description of the Related Art

Squeezable, tube-type dispensers are used for containing and dispensing numerous materials, such as toothpaste, medical and chemical pastes, adhesives, hair products, gels, and caulk, for example. The basic structure of such squeezable tubes includes an elongated, typically cylindrical hollow tube, formed of a flexible material, with one closed end and one end having a neck or spout for dispensing. The neck or spout is usually cylindrical and typically defines a circular bore for dispensing of the material. The closed end of the tube is a generally flat and sealed. A closure of the spout is provided h a removable cap, typically through the use of cooperating threads or a snap-fit apparatus.

The use of squeezable tubes is deceptively simple, in that the contents are dispensed by removing the cap and squeezing the tube portion with sufficient force to extrude the contents outwardly through the spout. As the contents are dispensed, the tube tends to flatten. Despite the basic simplicity of the use of squeezable tube dispensers, problems still arise as the material within the tube is dispensed. The flattening of the tube is not controlled and thus simply flattens wherever it is squeezed. Repeated dispensing of the material in the tube results in unevenly distributed contents throughout the ever-flattening tube. As a result, the user must periodically, if not continuously, manipulate the tube to flatten the partially filled tube from the closed end bottom toward the head end. This process is necessary to avoid undesired waste and uneven distribution of the material within the tube. Failure to flatten the tube from the bottom can make it difficult to empty the tube completely.

Although a wide variety of squeezing tools exist to alleviate this problem, such tools are often overly complex, burdensome to use, or may be easily lost, since they are stored separately from the squeezable tube dispenser. Further, such squeezing tools typically do not address the issue of stability of the tube; i.e., prevention of movement of the tube on a flat surface, such as a countertop, during squeezing. Thus, a toothpaste cap with dental care tools solving the aforementioned problems is desired.

SUMMARY

A toothpaste cap with dental care tools can be used to detachably cover the open end of a squeezable tube dispenser, such as those typically associated with toothpaste. The cap is formed as a hollow body having a closed upper end, an open lower end, and at least one sidewall extending between the upper end and the lower end. According to an embodiment, the cap can include a first sidewall having a flat, planar contour and a second sidewall having an arcuate contour. Preferably, the second sidewall has a substantially constant radius of curvature; i.e., the cross-sectional contour forms a circular section, similar to a conventional tube cap. The closed upper end may have a flat planar contour, also similar to a conventional tube cap.

A cylindrical retaining member is mounted, substantially centrally, to a lower face of the closed upper end within the hollow body. The cylindrical retaining member is adapted for releasably receiving and sealing a spout of a squeezable tube dispenser, similar to a conventional tube dispenser cap. The cylindrical retaining member may be threaded on an inner face thereof, for receiving a threaded spout, or may be adapted for releasable frictional engagement with the spout, dependent upon the particular type of tube dispenser. The flat, planar first sidewall of the hollow body is adapted for pressing against the squeezable tube dispenser to selectively manipulate contents thereof.

In an alternative embodiment, the toothpaste cap with dental care tools includes a hollow body having a closed upper end, an open lower end, and a substantially cylindrical sidewall. A cylindrical retaining member is mounted to a lower face of the closed upper end within the hollow body, substantially centrally with respect to the closed upper end, similar to the previous embodiment. A squeezing member is secured to an exterior surface of the substantially cylindrical sidewall of the hollow body, adjacent the closed upper end thereof. As in the previous embodiment, the cylindrical retaining member is adapted for releasably receiving and sealing a spout of a squeezable tube dispenser. The squeezing member is adapted for pressing against the squeezable tube dispenser to selectively manipulate contents thereof. The squeezing member may have any suitable contouring and relative dimensions. For example, the squeezing member may be in the form of an elongated rod extending substantially tangentially with respect to the substantially cylindrical sidewall (i.e., extending orthogonal to the radius of the hollow body).

In a further alternative embodiment, the squeezing member may be removable, allowing for additional usage in combination with a variety of different dental cleaning heads. Similar to the previous embodiment, the toothpaste cap with dental care tools of the further alternative embodiment includes a hollow body having a closed upper end, an open lower end and a substantially cylindrical sidewall. However, the exterior surface of the substantially cylindrical sidewall has a groove formed therein. The squeezing member is releasably received within the groove. The groove is preferably formed tangentially with respect to the substantially cylindrical sidewall, allowing the squeezing member to extend tangentially.

As in the previous embodiment, a cylindrical retaining member is mounted to a lower face of the closed upper end within the hollow body. An inner face of the cylindrical retaining member may threaded, allowing for releasable engagement with a spout of the tube dispenser. The squeezing member has a pair of opposed longitudinal ends, which may be chamfered or otherwise contoured for releasable engagement with at least one cleaning head. Each cleaning head has at least one sidewall, an open end and a closed end. The open end thereof is adapted for releasable mounting on one the ends of the squeezing member.

A wide variety of different cleaning heads may be provided. For example, the closed end of the cleaning head may have a concave surface adapted for engaging a surface of a tooth. As another example, the closed end has a tapered surface adapted for cleaning between an adjacent pair of teeth. An annular disc is mounted within the substantially cylindrical sidewall about the cylindrical retaining member. The annular disc has at least one opening formed therethrough for removably receiving the at least one cleaning head.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
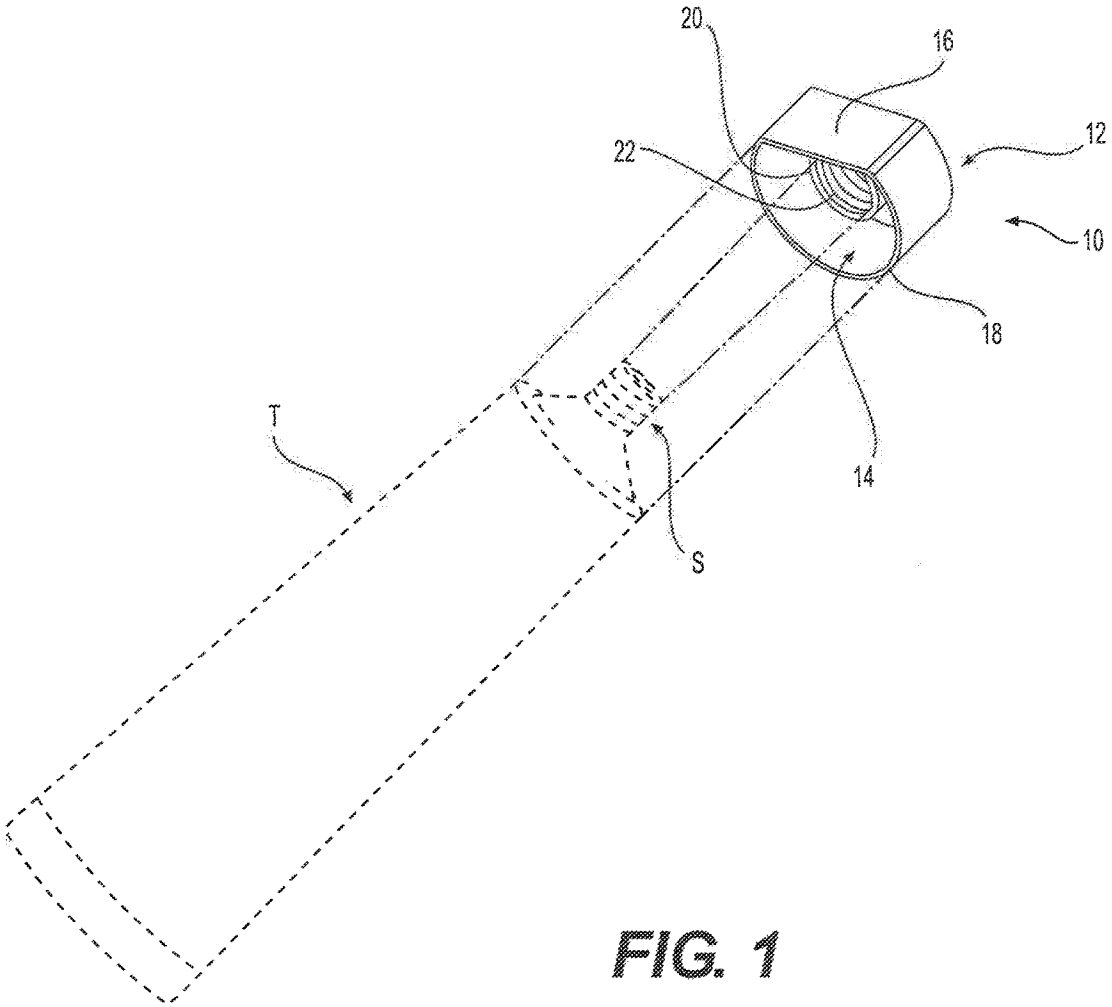
FIG. 1 is an environmental perspective view of a toothpaste cap with dental care tools.
Figure 2:
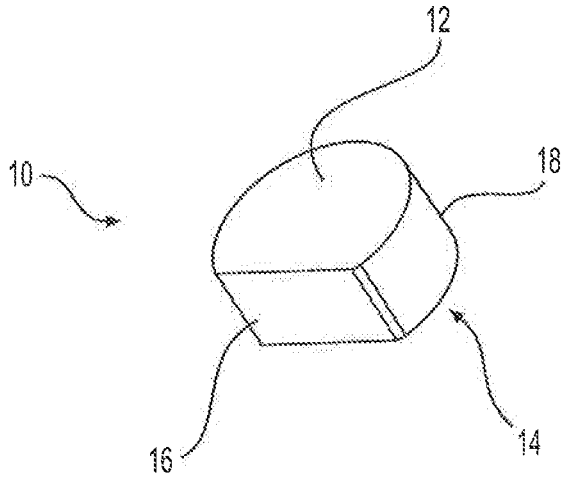
FIG. 2 is an upper perspective view of the toothpaste cap with dental care tools.
Figure 3:
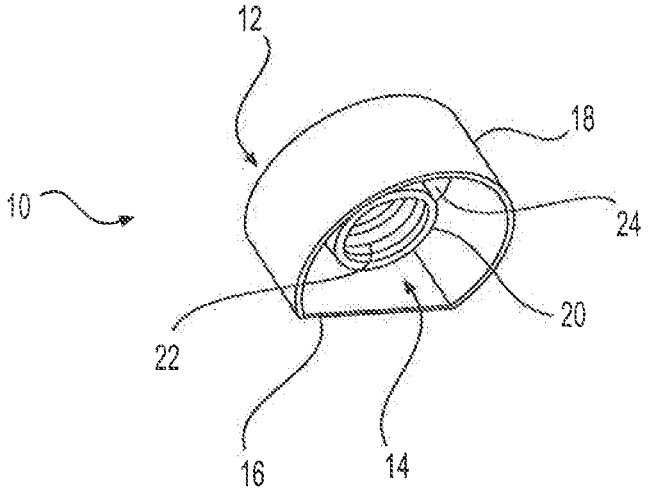
FIG. 3 is a lower perspective view of the toothpaste cap with dental care tools.

The toothpaste cap with dental care tools 10 can be used to detachably cover the open end of a conventional, squeezable tube dispenser, such as those typically associated with toothpaste, industrial pastes, medical and chemical pastes, adhesives, hair products, gels, caulk and the like. It should be understood that exemplary tube T, including a dispensing spout 5, shown in FIG. 1 is shown for exemplary purposes only. As shown in FIGS. 1-3, the toothpaste cap with dental care tools 10 is formed as a hollow body, which may be manufactured from any suitable material, such as hard plastic or the like, having a closed upper end 12, an open lower end 14, and at least one sidewall extending between the upper end 12 and the lower end 14. The closed upper end 12 may have a flat planar contour, also similar to a conventional tube cap. It should be understood that the relative dimensions of toothpaste cap with dental care tools 10 may be varied dependent upon the particular size and type of tube to which the device 10 is being applied.

A cylindrical retaining member 20 is mounted, substantially centrally, to a lower face 24 of the closed upper end 12 within the hollow body. The cylindrical retaining member 20 is adapted for releasably receiving and sealing the spout S of the squeezable tube dispenser T, similar to a conventional tube dispenser cap. The cylindrical retaining member may have threads 22 formed on an inner face thereof, for receiving a threaded spout, or may be adapted for releasable frictional engagement with the spout, dependent upon the particular type of tube dispenser. It should be understood that the inner surface of the cylindrical retaining member 20 can be similar to that of a conventional cap for a squeezable tube dispenser and may be manufactured in any suitable manner for releasably covering and sealing the dispensing spout, dependent upon the particular type of tube to which device 10 is being applied.

Figure 4:
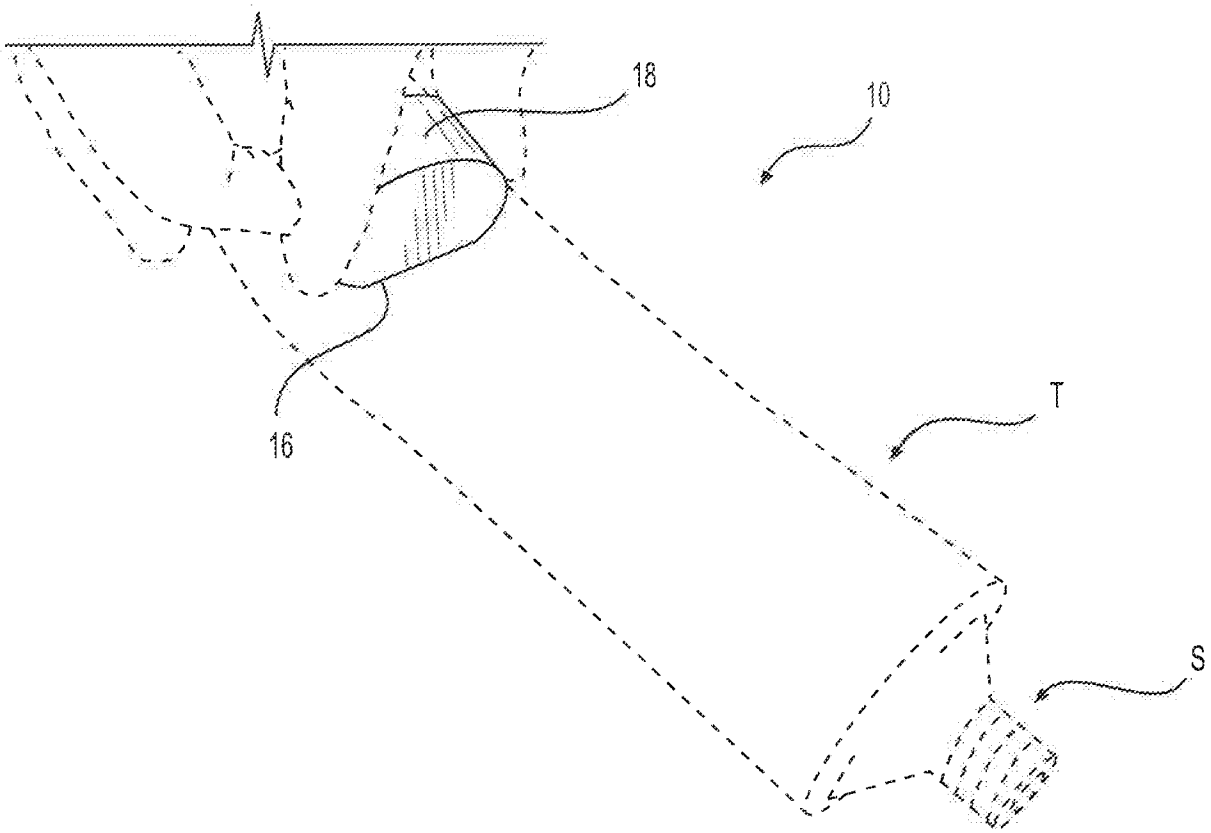
FIG. 4 is an environmental perspective view of the toothpaste cap with dental care tools, shown being used for squeezing the contents of an exemplary tube dispenser.

According to an embodiment (FIGS. 1-3), the toothpaste cap with dental care tools 10 can have a first sidewall 16 having a flat planar contour and a second sidewall 18 having an arcuate contour. Preferably, the second sidewall 18 has a substantially constant radius of curvature; i.e., the cross-sectional contour of second sidewall 18 forms a circular section, similar to a conventional tube cap. As shown in FIG. 4, the flat, planar first sidewall 16 of the hollow body is adapted for pressing against the squeezable tube dispenser T to selectively manipulate the contents thereof. Thus, when the user wishes to, for example, squeeze or push the contents of tube T towards spout S, the device 10 is removed from spout S, the user grips the second sidewall 18 (as shown in FIG. 4), contacts the flat, planar sidewall 16 against an exterior of tube T, and squeezes the tube T, with sidewall 16, pushing device 10 forward, toward spout S.

An alternative embodiment of the toothpaste cap with dental care tools, designated 100 in FIGS. 5-8, includes a hollow body having a closed upper end 112, an open lower end 114, and a substantially cylindrical sidewall 116. Although sidewall 116 may be formed with alternative contours dependent upon the particular type of tube T to which device 100 is being applied, sidewall 116 does not include a specialized face for squeezing the tube T (unlike device 10 of FIGS. 1-4). The closed upper end 112 may have a flat planar contour, similar to a conventional tube cap. It should be understood that the relative dimensions of toothpaste cap with dental care tools 100 may be varied dependent upon the particular size and type of tube to which the device 100 is being applied.

Figure 5:
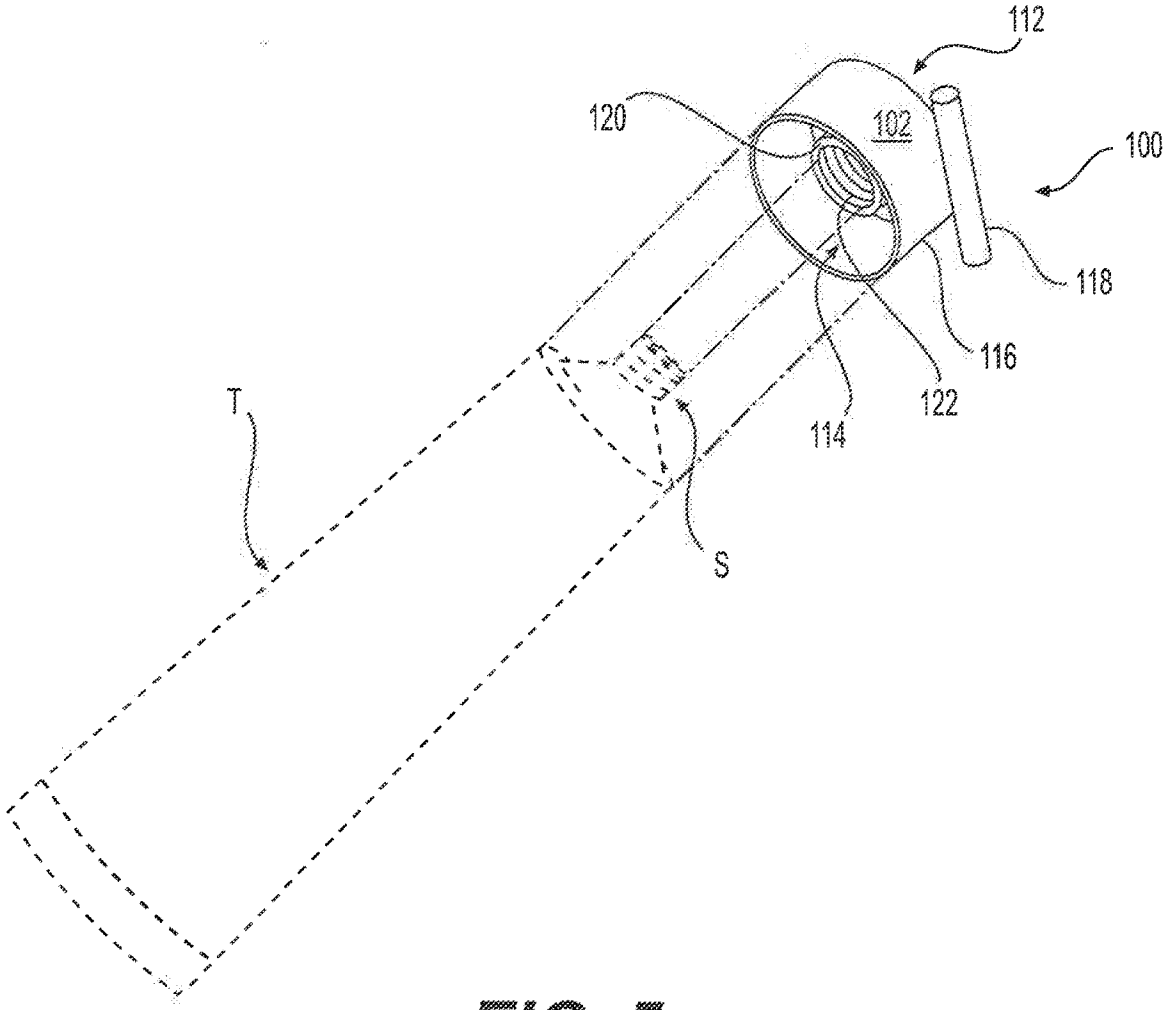
FIG. 5 is an environmental perspective view of an alternative embodiment of the toothpaste cap with dental care tools.
Figure 6:
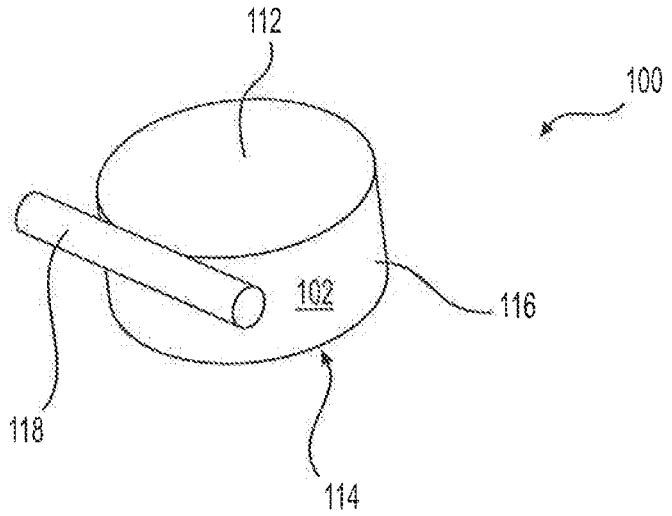
FIG. 6 is an upper perspective view of the toothpaste cap with dental care tools of FIG. 5.
Figure 7:
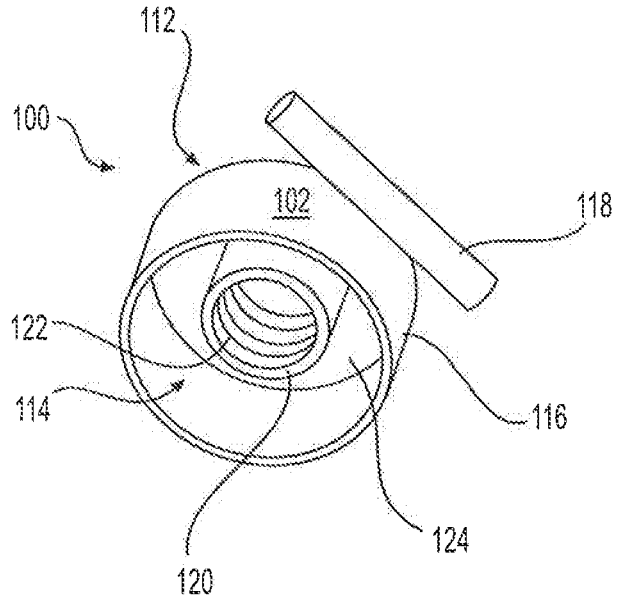
FIG. 7 is a lower perspective view of the toothpaste cap with dental care tools of FIG. 5.

Similar to the previous embodiment, a cylindrical retaining member 120 is mounted to a lower face 124 of the closed upper end 112 within the hollow body, substantially centrally with respect to closed upper end 112. A squeezing member 118 is secured to an exterior surface 102 of the substantially cylindrical sidewall 116, adjacent the closed upper end 112. The squeezing member 118 may have any suitable contouring and relative dimensions. For example, as best seen in FIGS. 5-7, the squeezing member 118 may be in the form of an elongated rod extending substantially tangentially with respect to the substantially cylindrical sidewall 116 (i.e., extending orthogonal to the radius of the hollow body).

As in the previous embodiment, the cylindrical retaining member 120 is adapted for releasably receiving and sealing spout S of squeezable tube dispenser T. The cylindrical retaining member 120 may have threads 122 formed on an inner face thereof, for receiving a threaded spout, or may be adapted for releasable frictional engagement with the spout, dependent upon the particular type of tube dispenser. It should be understood that the inner surface of the cylindrical retaining member 120 is similar to that of a conventional cap for squeezable tube dispenser and may be manufactured in any suitable manner for releasably covering and sealing the dispensing spout, dependent upon the particular type of tube to which device 100 is being applied.

Figure 8:
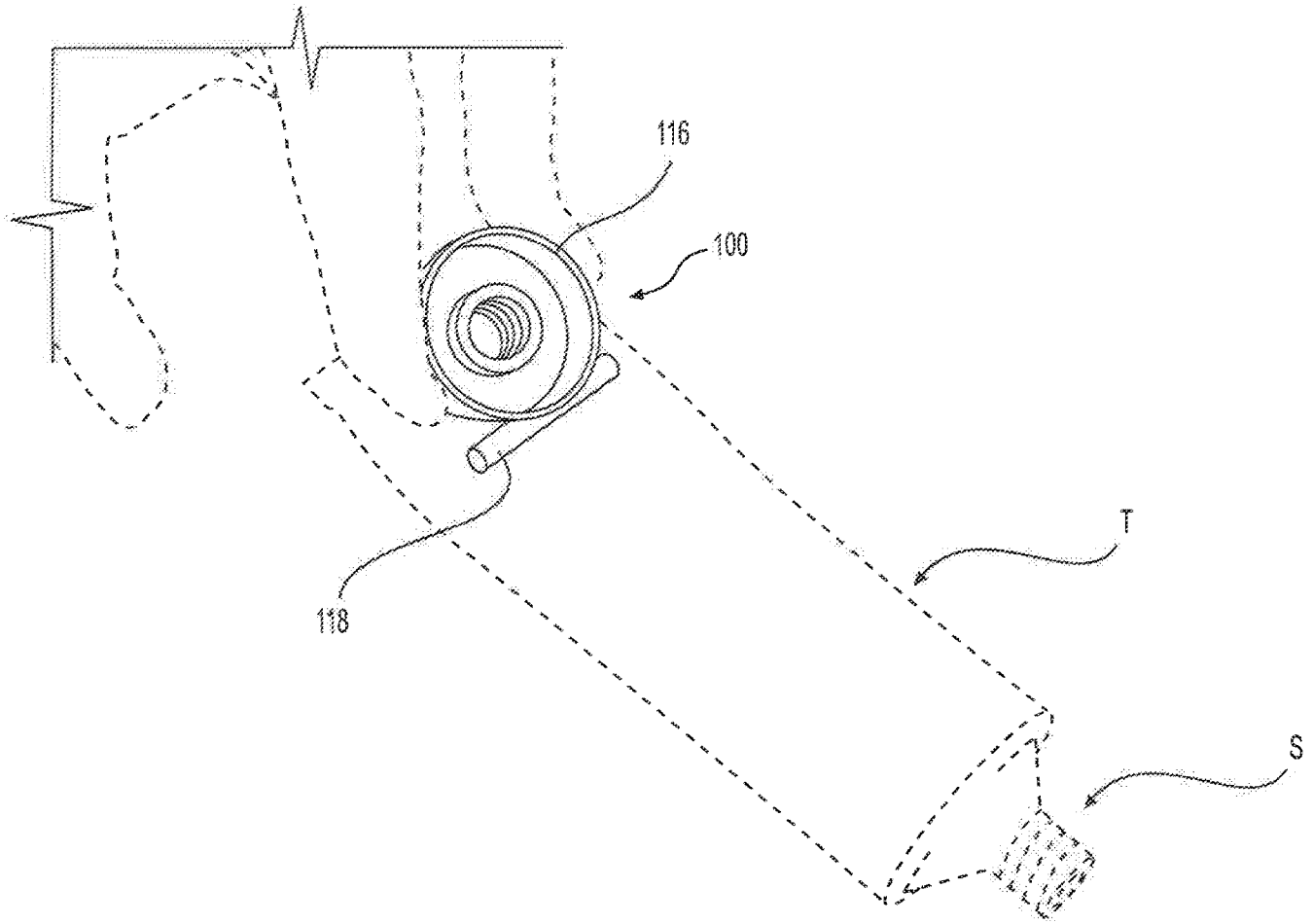
FIG. 8 is an environmental perspective view of the toothpaste cap with dental care tools of FIG. 5, shown being used for squeezing the contents of an exemplary tube dispenser.

As shown in FIG. 8, the squeezing member 118 is adapted for pressing against the squeezable tube dispenser T to selectively manipulate the contents thereof. Thus, when the user wishes to, for example, squeeze or push the contents of tube T towards spout S, the device 100 is removed from spout 5, the user grips the sidewall 116, contacts the squeezing member 118 against an exterior of tube T, and squeezes the tube with squeezing member 118, pushing device 100 forward, toward spout S.

Figure 9A:
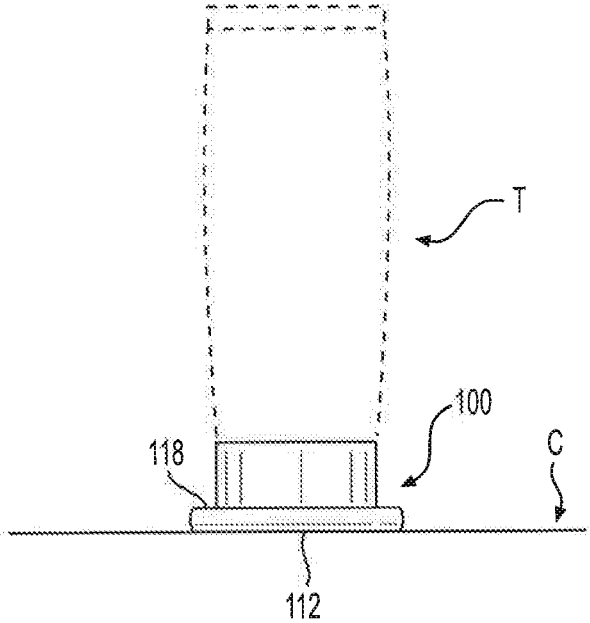
FIG. 9A is an environmental front view of the toothpaste cap with dental care tools of FIG. 5, showing mounting of the toothpaste cap with dental care tools on a conventional countertop.
Figure 9B:
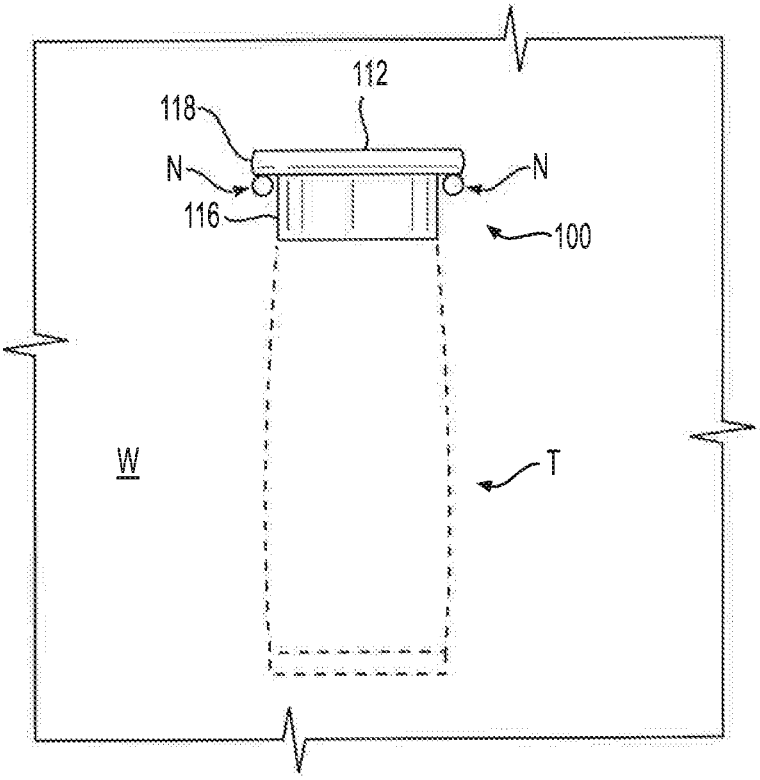
FIG. 9B is an environmental front view of the toothpaste cap with dental care tools of FIG. 5, showing suspension of the toothpaste cap with dental care tools by a pair of nails.

As shown in FIG. 9A, and as noted above, closed upper end 112 may be flat or planar, allowing the closed upper end 112 to be stably supported on a horizontal surface, such as a conventional countertop C. Additionally, as shown in FIG. 9B, the length of squeezing member 118 is preferably greater than the diameter of sidewall 116 allowing the toothpaste cap with dental care tools 100 to be hung from a wall W or the like by a pair of nails N, hooks or the like. It should be understood that squeezing member may have a wide variety of different uses, such as, for example, being used to pierce a foil cover of sealing spout S.

Figure 10:
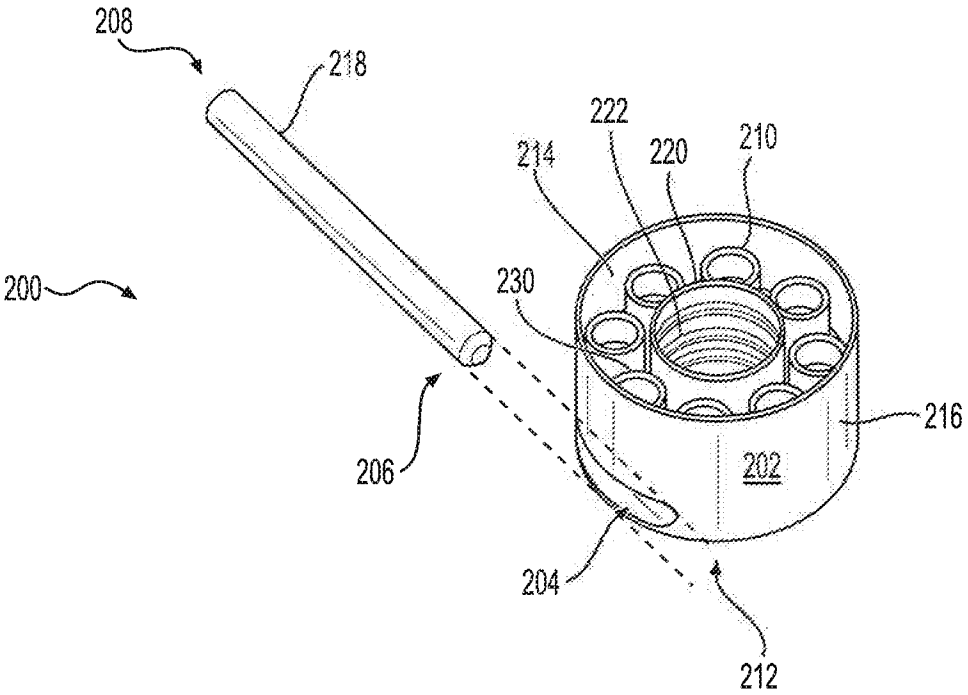
FIG. 10 is a perspective view of another alternative embodiment of the toothpaste cap with dental care tools.

The alternative toothpaste cap with dental care tools 200 of FIG. 10 is similar to the previous embodiment, but with a removable squeezing member 218, which allows for additional usage in combination with a variety of different dental cleaning heads 210, 230. Similar to the previous embodiment, the toothpaste cap with dental care tools 200 includes a hollow body having a closed upper end 212, an open lower end 214 and a substantially cylindrical sidewall 216. However, as shown, the exterior surface 202 of the substantially cylindrical sidewall 216 has a groove 204 formed therein. The squeezing member 218 is releasably received within the groove 204, allowing the squeezing member 218 to be removably held therein via frictional engagement therewith. The groove 204 is preferably formed tangentially with respect to the substantially cylindrical sidewall 216, allowing the squeezing member 218 to extend tangentially, similar to the previous embodiment.

Figure 11:
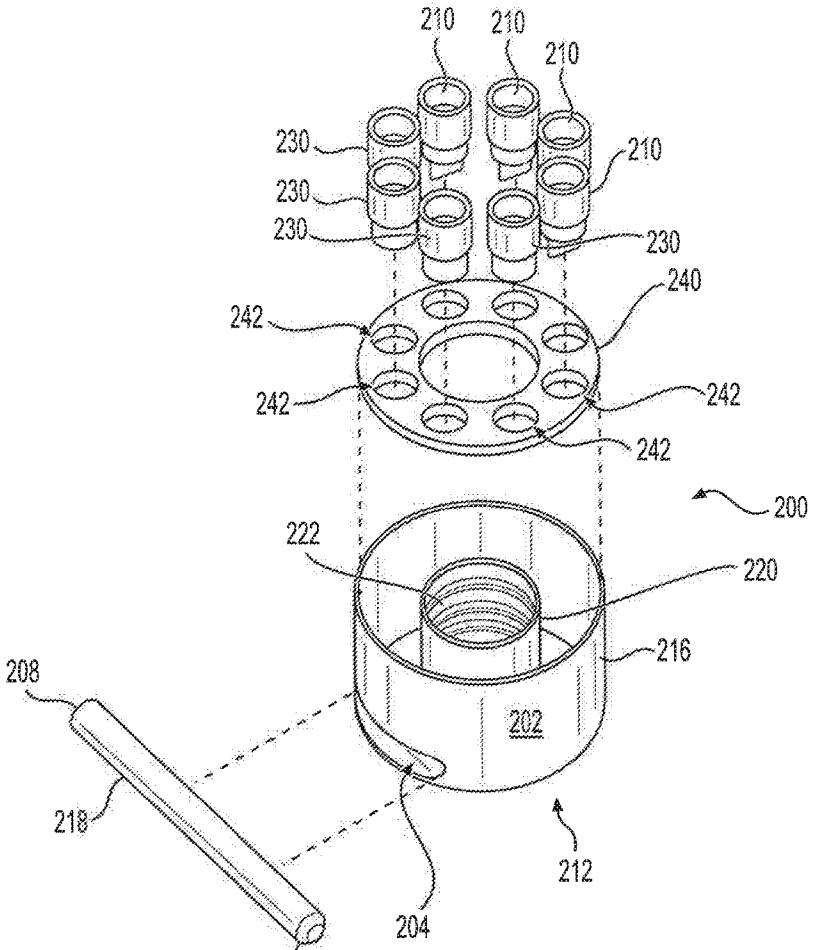
FIG. 11 is an exploded perspective view of the toothpaste cap with dental care tools of FIG. 10.

As in the previous embodiment, a cylindrical retaining member 220 is mounted to a lower face of the closed upper end 212 within the hollow body. An inner face 222 of the cylindrical retaining member 220 may threaded, as shown, allowing for releasable engagement with the spout S of the tube dispenser T. The squeezing member 218 has a pair of opposed longitudinal ends 206, 208, which may be chamfered or otherwise contoured for releasable engagement with at least one cleaning head. In FIGS. 10 and 11, four cleaning heads of a first type 230 and four cleaning heads of a second type 210 are shown. It should be understood that the number and type of cleaning heads are shown for exemplary purposes only, and that any desired number of cleaning heads may be included and, similarly, any number of different types of cleaning heads may be used. Different types of cleaning heads may be manufactured in different colors, or otherwise be made visually distinct from one another, allowing the user to easily select a desired type of cleaning head.

Figure 14B:
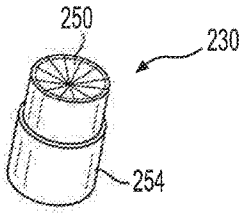
FIG. 14B is a top perspective view of the first cleaning head of FIG. 14A.
Figure 14D:
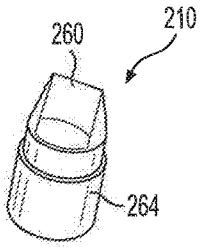
FIG. 14D is a top perspective view of the second cleaning head of FIG. 14C.
Figure 14A:
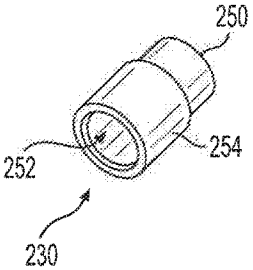
FIG. 14A is a bottom perspective view of a first cleaning head of the toothpaste cap with dental care tools of FIG. 10.

Exemplary first cleaning head 230, as shown in FIGS. 14A and 14B, has at least one sidewall 254, an open end 252 and a closed end 250. The open end 252 is adapted for releasable mounting on one the ends 206, 208 of the squeezing member 218. As shown in FIG. 14B, the closed end 250 of first cleaning head 230 has a concave surface adapted for engaging, gently polishing and cleaning a surface of a tooth. The concave closed end 250 may be made from an elastic material, such as rubber or the like, to avoid scratching the tooth's surface. Alternatively, closed end 250 (or the entirety of first cleaning head 230) may be made from *Salvadora persica*, a type of wood which is commonly used as a teeth cleaning stick throughout the Arabian Peninsula.

Figure 14C:
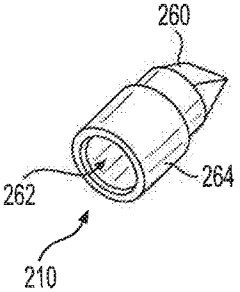
FIG. 14C is a bottom perspective view of a second cleaning head of the toothpaste cap with dental care tools of FIG. 10.

Exemplary second cleaning head 210, as shown in FIGS. 14C and 14D, also has at least one sidewall 264, an open end 262 and a closed end 260. The open end 262 is adapted for releasable mounting on one the ends 206, 208 of the squeezing member 218, and the closed end 260 has a tapered surface adapted for cleaning between an adjacent pair of teeth. The tapered end 260 can be worked between teeth to externally clean the grooves between teeth, but not penetrate between the teeth, allowing for safe removal of dental deposits between the teeth. Similar to first cleaning head 230, closed end 260 (or the entirety of second cleaning head 210) may be made from *Salvadora persica*.

Figure 12:
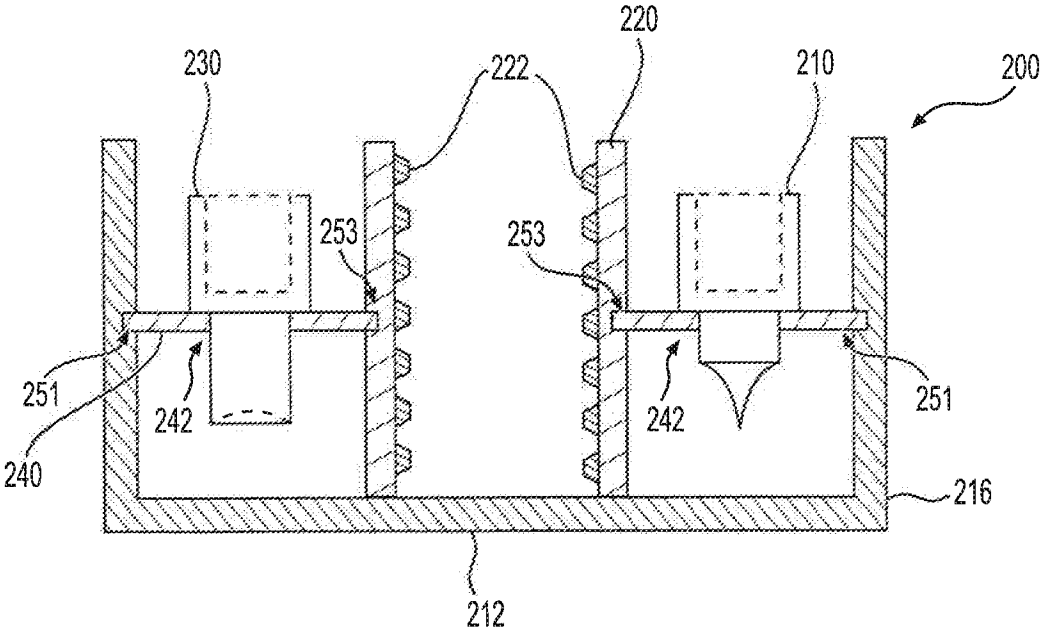
FIG. 12 is a side view in section of the toothpaste cap with dental care tools of FIG. 10.

As best seen in FIGS. 11 and 12, an annular disc 240 is mounted within the substantially cylindrical sidewall 216 and is mounted about the cylindrical retaining member 220. The annular disc 240 has at least one opening 242 formed therethrough for removably receiving the at least one cleaning head. In the non-limiting example of FIGS. 10 and 11, four such openings 242 are formed through annular disc 240 for receiving four of the first cleaning heads 230 and four of the second cleaning heads 210. As shown in FIG. 12, a circumferential groove 251 may be formed in the inner face of sidewall 216. A corresponding circumferential groove 253 may be formed in the outer face of cylindrical retaining member 220. Annular disc 240 may be securely mounted within toothpaste cap with dental care tools 200 through engagement with grooves 251, 253, as shown.

Figure 13D:
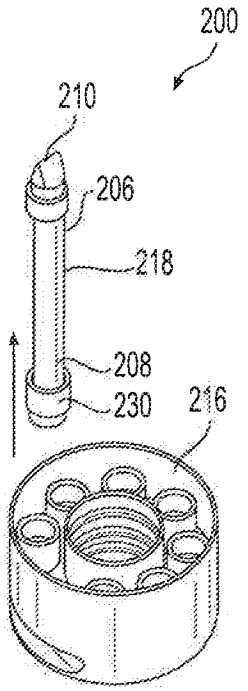
FIG. 13A, FIG. 13B, FIG. 13C and FIG. 13D illustrate successive steps of the usage of the toothpaste cap with dental care tools of FIG. 10.
Figure 13C:
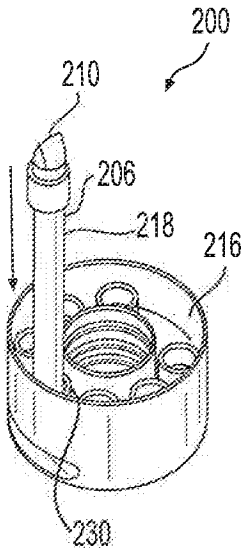
Figure 13B:
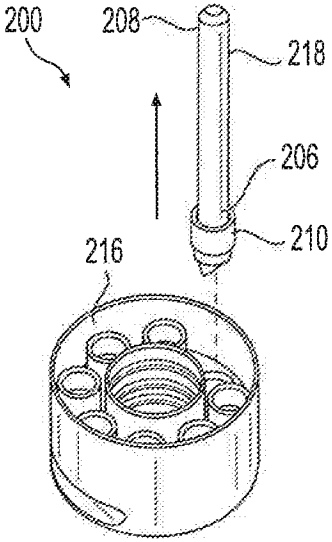
Figure 13A:
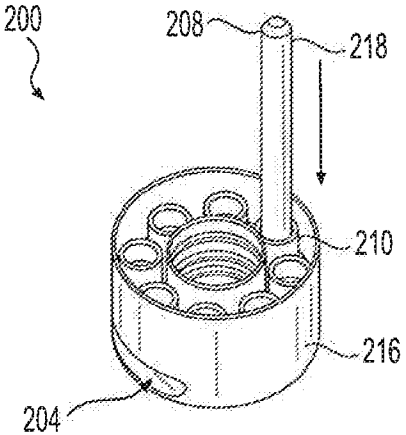

In use, the squeezing member 218 is removed from groove 204 and, as shown in FIG. 13A, first end 206 is inserted into the open end of a selected one of the cleaning heads. In FIG. 13A, squeezing member 218 is shown engaging one of the second type of cleaning heads 210, although it should be understood that this is shown for exemplary purposes only. Once the chamfered or otherwise contoured end 206 is received within the open end of the cleaning head, the cleaning head is releasably secured thereon, as shown in FIG. 13B. The user may then add another cleaning head by inserting the second end 208 into another cleaning head, as shown in FIG. 13C. As illustrated in FIG. 13D, the user then has the choice of using either cleaning head 210 or cleaning head 230.

It is to be understood that the toothpaste cap with dental care tools is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A toothpaste cap with dental care tools, comprising:

a hollow body having a closed upper end, an open lower end and a substantially cylindrical sidewall, wherein an exterior surface of the substantially cylindrical sidewall has a groove formed therein;

a cylindrical retaining member mounted to a lower face of the closed upper end within said hollow body; and a squeezing member releasably received within the groove formed in the exterior surface of the substantially cylindrical sidewall, whereby said cylindrical retaining member is adapted for releasably receiving and sealing a spout of a squeezable tube dispenser, and the squeezing member is adapted for pressing against the squeezable tube dispenser to selectively manipulate contents thereof;

wherein the squeezing member has a pair of opposed longitudinal ends;

an annular disc mounted within the substantially cylindrical sidewall and mounted about the cylindrical retaining member, the annular disc having at least one opening formed therethrough for removably receiving an at least one cleaning head.

2. The toothpaste cap with dental care tools as recited in claim 1, wherein the closed upper end of said hollow body has a flat planar contour.

3. The toothpaste cap with dental care tools as recited in claim 1, wherein an inner face of said cylindrical retaining member is threaded.

4. The toothpaste cap with dental care tools as recited in claim 1, wherein said squeezing member comprises an elongated rod.

5. The toothpaste cap with dental care tools as recited in claim 1, wherein the groove is formed tangentially with respect to the substantially cylindrical sidewall, such that the squeezing member extends tangentially with respect to the substantially cylindrical sidewall.

6. The toothpaste cap with dental care tools as recited in claim 1, wherein the at least one cleaning head is mounted on at least one of the ends of the squeezing member.

7. The toothpaste cap with dental care tools as recited in claim 1, wherein the at least one cleaning head has at least one sidewall, an open end and a closed end, the open end being adapted for releasable mounting on the at least one of the ends of the squeezing member.

8. The toothpaste cap with dental care tools as recited in claim 7, wherein the closed end of the at least one cleaning head has a concave surface adapted for engaging a surface of a tooth.

9. The toothpaste cap with dental care tools as recited in claim 7, wherein the closed end of the at least one cleaning head has a tapered surface adapted for cleaning between an adjacent pair of teeth.

10. A tube dispenser having a toothpaste cap with dental care tools, comprising: a squeezable tube dispenser having a spout; and a cap, comprising:

a hollow body having a closed upper end, an open lower end and a substantially cylindrical sidewall, wherein an exterior surface of the substantially cylindrical sidewall has a groove formed therein, wherein the closed upper end has a top surface forming a full circle;

a cylindrical retaining member mounted to a lower face of the closed upper end within said hollow body; and a squeezing member releasably received within the groove formed in the exterior surface of the substantially cylindrical sidewall, whereby said cylindrical retaining member is adapted for releasably receiving and sealing a spout of a squeezable tube dispenser, and the squeezing member is adapted for pressing against the squeezable tube dispenser to selectively manipulate contents thereof.

11. The tube dispenser as recited in claim 10, wherein the closed upper end of said hollow body has a flat planar contour.

12. The tube dispenser as recited in claim 10, wherein an inner face of said cylindrical retaining member is threaded.

13. The tube dispenser as recited in claim 10, wherein said squeezing member comprises an elongated rod.

14. The tube dispenser as recited in claim 13, wherein the groove is formed tangentially with respect to the substantially cylindrical sidewall, such that the squeezing member extends tangentially with respect to the substantially cylindrical sidewall.

15. The tube dispenser as recited in claim 10, further comprising at least one cleaning head releasably mounted on at least one end of the squeezing member, the at least one cleaning head having at least one sidewall, an open end and a closed end.

16. The tube dispenser as recited in claim 15, further comprising an annular disc mounted within the substantially cylindrical sidewall and mounted about the cylindrical retaining member, the annular disc having at least one opening formed therethrough for removably receiving the at least one cleaning head.

17. The tube dispenser as recited in claim 16, wherein the closed end of the at least one cleaning head has a concave surface adapted for engaging a surface of a tooth.

18. The tube dispenser as recited in claim 16, wherein the closed end of the at least one cleaning head has a tapered surface adapted for cleaning between an adjacent pair of teeth.

* * * * *